US007066680B2

(12) United States Patent
Wiley

(10) Patent No.: US 7,066,680 B2
(45) Date of Patent: Jun. 27, 2006

(54) METHOD OF FORMING AN INLAID PATTERN IN AN ASPHALT SURFACE

(75) Inventor: Patrick Carl Wiley, Chilliwack (CA)

(73) Assignee: Integrated Paving Concepts Inc., Surrey (CA)

( * ) Notice: Subject to any disclaimer, the term of this patent is extended or adjusted under 35 U.S.C. 154(b) by 384 days.

(21) Appl. No.: 10/000,448

(22) Filed: Dec. 4, 2001

(65) Prior Publication Data

US 2003/0103810 A1 Jun. 5, 2003

(51) Int. Cl.
*E01C 11/00* (2006.01)

(52) U.S. Cl. ..... 404/75; 404/93
(58) Field of Classification Search ..... 404/75, 404/93, 72, 89, 94
See application file for complete search history.

(56) References Cited

U.S. PATENT DOCUMENTS 1,063,752 A 6/1913 Walling
1,950,169 A 3/1934 Farasey ..... 94/1.5

(Continued)

FOREIGN PATENT DOCUMENTS

AU WO 87/02724 5/1987 ..... 9/8
CA 2 361 056 5/2002

(Continued)

OTHER PUBLICATIONS

Cataphote, Cata–Groove Snow Plow Resistant Thermoplastic Marking Material, Pags 1–5, dated Jul. 1998.
PREMARK road marking material, from www.intertraffic-.com, no date.*

(Continued)

*Primary Examiner*—Gary S. Hartmann
(74) *Attorney, Agent, or Firm*—Oyen Wiggs Green & Mutala LLP

(57) ABSTRACT

This application relates to a method of forming an inlaid pattern in an asphalt surface. The pattern may be selected for functional or decorative purposes. In one embodiment the method comprises the steps of providing a first template having a predetermined pattern; impressing the first template into the asphalt surface when the asphalt surface is in a pliable state to form an impression therein; removing the first template from the asphalt surface to expose the impression; providing a second template having a predetermined pattern matching the pattern of the first template; inserting the second template into the impression; and fixing the second template in position within the impression to form the inlaid pattern. The second template may consist of a preformed thermoplastic grid having a color and/or texture contrasting with the asphalt surface. In another embodiment the second template may include a light source for illuminating the template after it has been fixed in position.

25 Claims, 4 Drawing Sheets

U.S. PATENT DOCUMENTS

| | | | | | |
|---|---|---|---|---|---|
| 2,196,890 | A | * | 4/1940 | Bensen | 404/14 |
| 2,237,152 | A | * | 4/1941 | Larmour | 156/303.1 |
| 2,595,142 | A | * | 4/1952 | Herck | 264/31 |
| 2,866,992 | A | | 1/1959 | Toulmin, Jr. | 15/131.05 |
| 2,898,825 | A | * | 8/1959 | Walker et al. | 404/12 |
| 3,410,185 | A | * | 11/1968 | Harrington | 404/77 |
| 3,664,242 | A | * | 5/1972 | Harrington et al. | 404/77 |
| 3,832,079 | A | * | 8/1974 | Moorhead | 404/72 |
| 3,874,806 | A | | 4/1975 | Grist et al. | 404/93 |
| 3,910,711 | A | * | 10/1975 | Moorhead | 404/89 |
| 4,082,587 | A | * | 4/1978 | Eigenmann | 156/71 |
| 4,105,354 | A | | 8/1978 | Bowman | 404/72 |
| 4,135,840 | A | * | 1/1979 | Puccini et al. | 404/93 |
| 4,376,007 | A | * | 3/1983 | Eigenmann | 156/497 |
| 4,685,824 | A | * | 8/1987 | Eigenmann | 404/9 |
| 4,776,723 | A | * | 10/1988 | Brimo | 404/89 |
| 4,792,259 | A | * | 12/1988 | Eigenmann | 404/73 |
| 4,854,771 | A | * | 8/1989 | Corbin et al. | 404/79 |
| 4,889,666 | A | * | 12/1989 | Kawasaki | 264/426 |
| 5,033,906 | A | | 7/1991 | Jordan | 404/124 |
| 5,133,621 | A | | 7/1992 | Gonzales | 404/72 |
| 5,215,402 | A | * | 6/1993 | Stowell et al. | 404/93 |
| 5,421,670 | A | | 6/1995 | Meirick | 404/124 |
| 5,447,752 | A | | 9/1995 | Cobb | 427/270 |
| 5,487,526 | A | | 1/1996 | Hupp | 249/2 |
| 5,494,372 | A | | 2/1996 | Oliver et al. | 404/72 |
| 5,502,941 | A | * | 4/1996 | Zember et al. | 52/314 |
| 5,560,734 | A | | 10/1996 | McIntosh et al. | 404/15 |
| 5,653,552 | A | | 8/1997 | Wiley et al. | |
| 5,792,511 | A | | 8/1998 | Oliver et al. | 427/136 |
| 5,857,453 | A | * | 1/1999 | Caven et al. | 125/13.01 |
| 6,024,511 | A | | 2/2000 | Ross | 404/93 |
| 6,213,680 | B1 | | 4/2001 | Schaeffer et al. | 404/92 |
| 6,217,254 | B1 | * | 4/2001 | Wallgren et al. | 404/93 |
| 6,227,454 | B1 | * | 5/2001 | Wolf et al. | 239/1 |
| 6,303,058 | B1 | * | 10/2001 | Kelley et al. | 264/1.38 |
| 6,382,871 | B1 | * | 5/2002 | Ross | 404/75 |
| 6,503,558 | B1 | * | 1/2003 | Williamson | 427/180 |
| 2004/0048025 | A1 | * | 3/2004 | Lohnes | 428/40.1 |

FOREIGN PATENT DOCUMENTS

| | | | | |
|---|---|---|---|---|
| DE | 29 18 860 | | 11/1980 | 11/24 |
| DE | 43 14 240 | A1 | | 11/1993 |
| EP | 0 898 018 | A1 | | 2/1999 |
| FR | 1 596 269 | | | 7/1970 |
| FR | 2591143 | A1 | | 6/1987 |
| JP | 05098613 | A | | 4/1993 |
| JP | 411029905 | A | * | 2/1995 |
| JP | 02000345514 | A | * | 12/2000 |

OTHER PUBLICATIONS

"Distinctive Concrete", from www.distinctiveconcrete.com/products_stamp.htm, no date.*

3M Guidelines for Pavement Marking Applications in Grooved Pavement Surfaces: Stamark Pavement Marking Tape and Stamark Liquid Pavement Markings, Information Folder 5.18 Grooving Applications (Apr. 2002, replaces Memo dated Mar. 2000).*

3M Application of Stamark Pre–Cut Symbols and Legends, Information Folder 5.8 (May 2002, replaces IF 5.8 dated Mar. 199.*

"Pavements and Surface Materials", Technical Paper No. 8, by Jim Gibbons, 1999.*

"Installing thermoplastic crosswalks at the University of Wisconsin", PAVEMENT Magazine, pp. 12–14, Feb. 2004.*

Letter dated Dec. 19, 2003 from Laura Jensen, President of Flint Trading, Inc. addressed to Kristine Florio, Patent Examiner at the USPTO with enclosures.

Letter dated Dec. 19, 2003 from Laura Jensen, President of Flint Trading, Inc. Kristine Florio, Patent Examiner at the USPTO.

Letter dated Feb. 19, 2004 from Vagn Askjaer, Product Supply Manager of Flint Trading, Inc. addressed to Thomas B. Will, Supervisor at the USPTO.

Letter dated Feb. 20, 2004 from Vagn Askjaer, Product Supply Manager of Flint Trading, Inc. addressed to Thomas B. Will, Supervisor at the USPTO.

Letter dated Feb. 26, 2004 from Vagn Askjaer, Product Supply Manager of Flint Trading Inc. addressed to Thomas B. Will, Supervisor at the USPTO.

* cited by examiner

METHOD OF FORMING AN INLAID PATTERN IN AN ASPHALT SURFACE

TECHNICAL FIELD

This application relates to a method of forming an inlaid pattern in an asphalt surface. The pattern may be selected for functional or decorative purposes.

BACKGROUND

Various methods for forming patterns in asphalt surfaces are known in the prior art. The Applicant is the owner of U.S. Pat. No. 5,215,402 which describes a method of forming a pattern in an asphalt surface using a removable template. The template is compressed into a pliable asphalt surface to imprint a predetermined pattern simulating, for example, the appearance of bricks, cobblestones, interlocking paving stones or the like. The template is then lifted clear of the asphalt surface and the asphalt is allowed to harden. A thin layer of a cementitious coating may be applied to the imprinted asphalt to enhance the brick and mortar or other desired effect.

In the above-described method the template does not remain inlaid within the asphalt surface. The visual effect is created by the combination of the imprinted pattern and the decorative coating. One drawback to this method is that the decorative coating may wear off over time, particularly in high traffic areas.

It is known in the prior art to install traffic markings on asphalt surfaces. However, such markings typically project above the asphalt surface and are relatively bulky. In regions receiving frequent snowfalls during the winter months traffic markings may be removed or damaged by snowplow usage.

Another known method for producing traffic markings involves grinding grooves in asphalt surfaces and then pouring into the grooves a hot molten material which is allowed to set in place. However, this is a very time consuming procedure and is not well suited for forming complicated patterns or covering large surface areas.

The need has therefore arisen for improved methods and materials for inlaying patterns in asphalt surfaces.

SUMMARY OF INVENTION

In accordance with the invention, a method of forming an inlaid pattern in an asphalt surface is disclosed. The method includes the steps of:

(a) providing a first template having a predetermined pattern;

(b) impressing the first template into the asphalt surface when the asphalt surface is in a pliable state to form an impression therein;

(c) removing the first template from the asphalt surface to expose the impression;

(d) providing a second template having a predetermined pattern matching the pattern of the first template;

(e) inserting the second template into the impression; and (f) fixing the second template in position within the impression to form the inlaid pattern.

The method may include the step of heating the asphalt surface prior to impressing the first template into the asphalt surface.

The step of fixing the second template in position within the impression comprises heating the second template to cause the second template to bond to the asphalt surface. For example, the second template may be heated to a temperature within the range of about 150° F.–350° F.

The second template may comprise a pre-formed thermoplastic grid of unitary construction. The color of the grid may be selected to contrast with the color of the asphalt surface. In another embodiment the grid may include a light source for lighting the grid once it has been set in place in the asphalt surface. In other embodiments the grid may be luminescent or flourescent, such as when subjected to light of a suitable wavelength.

In one embodiment the second template may comprise an upper surface which is substantially flush with the surface of the asphalt when the second template is fixed in position. Alternatively, a portion of the second template may be raised above the asphalt surface or recessed below the asphalt surface when it is set in place.

The second template may be formed from a plurality of frame elements each having a relatively narrow width to facilitate compression of the template into the asphalt surface without the need to apply substantial compactive force. For example, the frame elements may have a width between ¼ inch and 1 inch.

In a further alternative embodiment the template may be compressed into the asphalt surface directly while the asphalt surface is in a pliable state and without deforming the desired predetermined pattern. The template is then fixed in place as in the embodiment described above.

BRIEF DESCRIPTION OF DRAWINGS

In drawings which illustrate embodiments of the invention, but which should not be construed as restricting the spirit or scope of the invention in any way, FIG. 1(*a*) is a perspective view of a portable heater for preheating an asphalt surface;

FIG. 1(*c*) is a perspective view of the first template being forcefully compressed into the asphalt surface using a compaction apparatus;

FIG. 1(*d*) is a perspective view of the first template being lifted clear of the asphalt surface to expose an impression having the predetermined pattern;

FIG. 1(*e*) is a perspective view of a second template having a pattern matching the pattern of the first template and showing the second template being lowered into the impression formed in the asphalt surface;

FIG. 1(*f*) is a perspective view of a portable heater for re-heating the asphalt surface to fix the second template in position within the impression;

FIG. 2(*b*) is a perspective view of a template defining a predetermined pattern and suitable for direct compression into the asphalt surface;

FIG. 2(*c*) is a perspective view of the template of FIG. 2(*b*) being forcefully compressed into the asphalt surface using a compaction apparatus without deforming the predetermined pattern;

FIG. 2(*d*) is a perspective view of a portable heater for re-heating the asphalt surface to fix the second template in position;

FIG. 4(*b*) is a plan elevational view of the method of FIG. 4(*a*).

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

With reference to the drawings, this application relates to methods and apparatus for imprinting an asphalt surface 10. As used in this patent application "asphalt" means a paving compound for constructing roads, driveways, walkways and the like which consists of a combination of bituminous binder, such as tar, and an aggregate, such as sand or gravel.

Figure 1B:
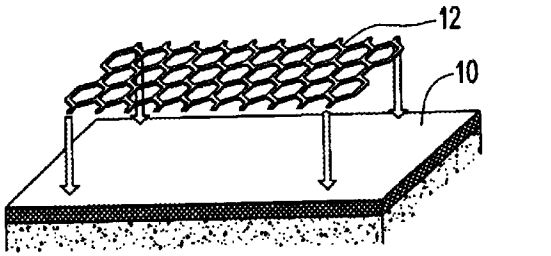
FIG. 1(*b*) is a perspective view of a first template defining a predetermined pattern for imprinting an asphalt surface.
Figure 1D:
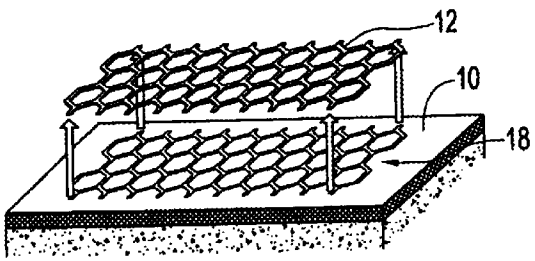
Figure 1F:
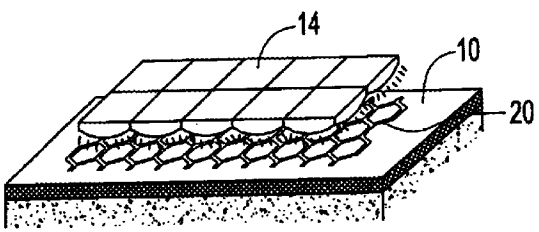
Figure 1A:
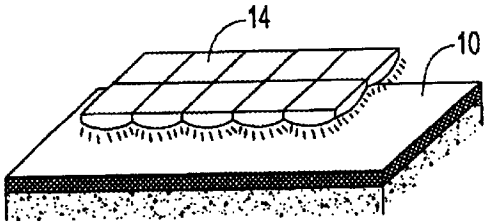
Figure 1C:
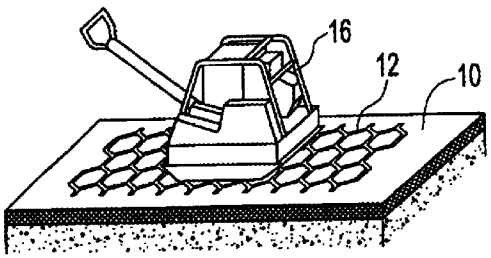
Figure 1E:
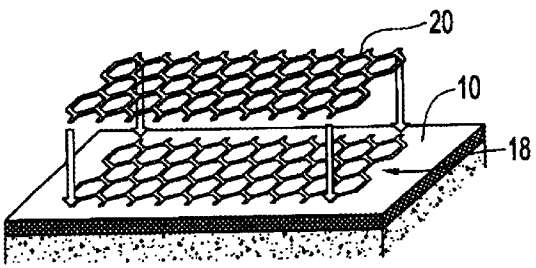
Figure 2B:
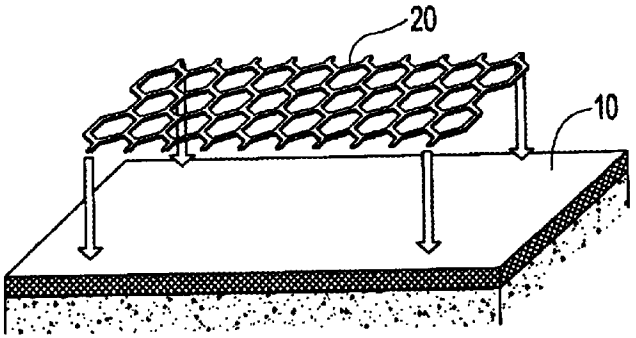
FIG. 2(*a*) is a perspective view of a portable heater for preheating an asphalt surface as in FIG. 1(*a*)
Figure 2D:
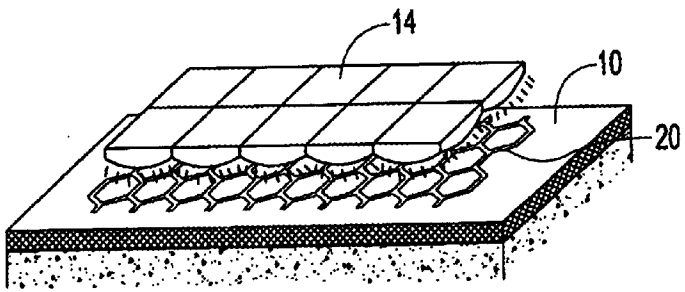
Figure 2A:
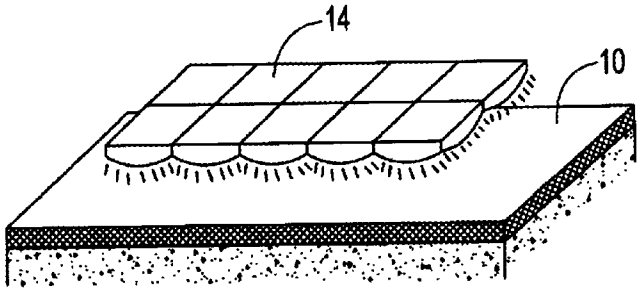
Figure 2C:
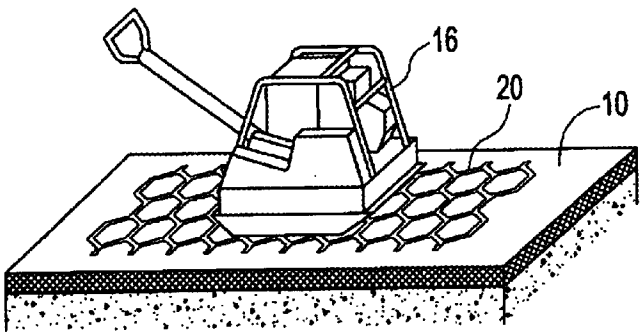
Figure 3:
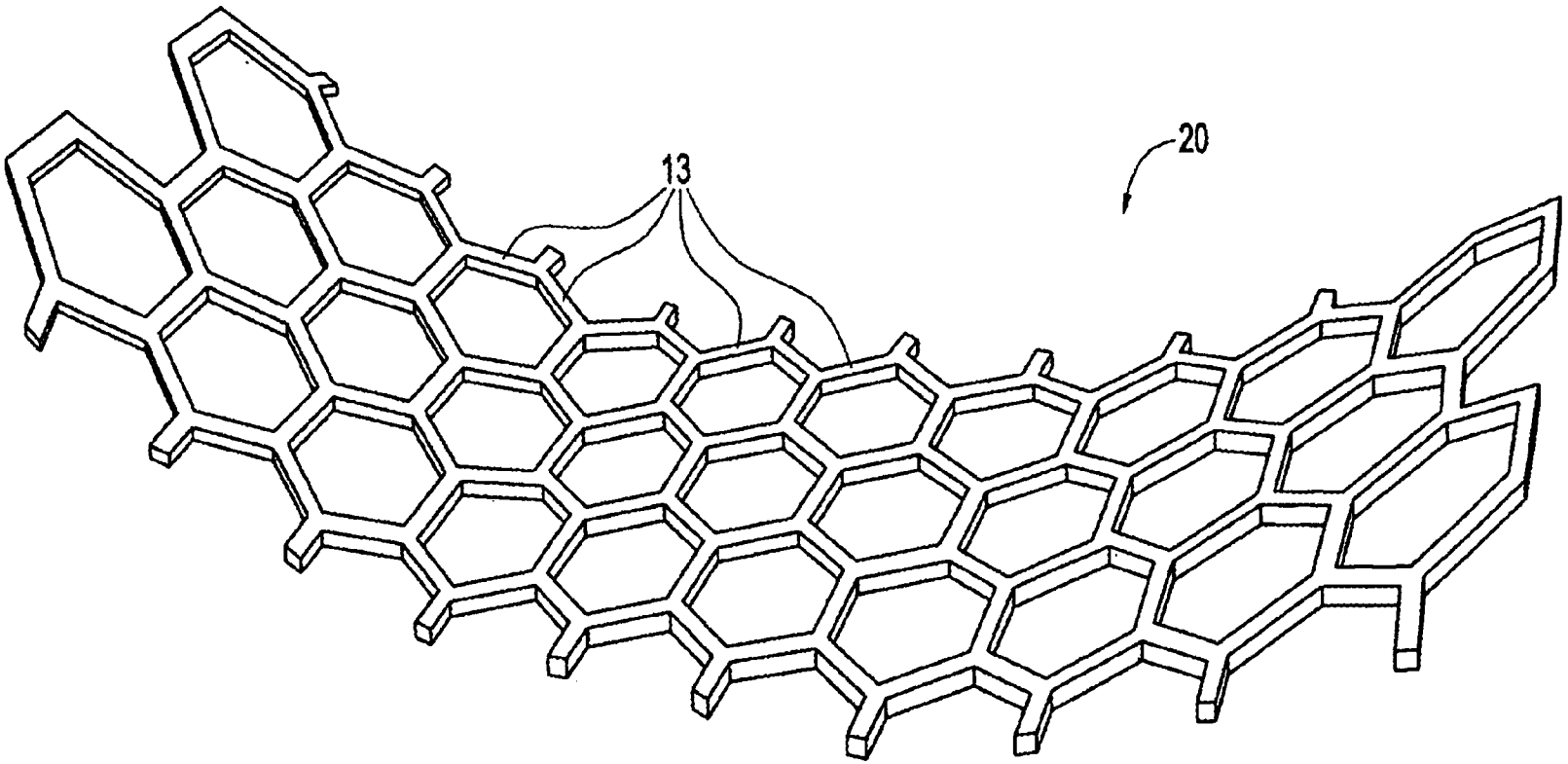
FIG. 3 is a perspective view of a template of FIGS. 1 and 2.

As shown in FIG. 1(*b*), a first template 12 is provided for imprinting a predetermined pattern in asphalt surface 10. The predetermined pattern may serve a specific function, such as a crosswalk marking, or it may be purely decorative. In the illustrated embodiment first template 12 comprises a flexible grid defining a plurality of open areas (FIG. 3). However, it should be appreciated that the structure of first template 12 may vary without departing from the invention. For example, template 12 may have a flat, continuous top surface and a plurality of projections formed on its bottom surface arranged in the desired pattern.

Template 12 is compressed into asphalt surface 10 when surface 10 is in a pliable state. For example, template 12 may be compressed into hot, freshly rolled asphalt (which is typically on the order of 150°–400° F. depending upon the type of ashpalt). Alternatively, a portable surface heater 14 may be provided (FIG. 1(*a*)) for preheating a preexisting asphalt surface 10 to a pliable state. Template 12 may be compressed into surface 10 with a mechanical compactor, such as a vibrating plate compactor 16 or a drum roller.

After template 12 has been compressed into asphalt surface 10 (FIG. 1(*c*)) it is removed to expose an impression 18 in the desired pattern (FIG. 1(*d*)). For example, impression 18 may consist of a plurality of channels or simulated grout lines. By way of another example, impression 18 may be the outline of a corporate logo or decorative design.

The next step in the process is to provide a second template 20 configured to fit within impression 18. As shown in FIG. 1(*e*)), second template 20 preferably has a shape and layout matching at least partly the pattern of first template 12. In one embodiment of the invention second template 20 may match the pattern of first template 12 (and hence impression 18) exactly. In an alternative embodiment of the invention, second template 20 may partially but not completely match the pattern of first template 12. In this case second template 20 partially fills impression 18 when it is inlaid within asphalt surface 10.

Second template 20 is positioned within impression 18 as shown in FIG. 1(*e*). In one embodiment of the invention second template 20 may consist of a preformed grid formed from a thermoplastic material. A suitable thermoplastic material is available from Lafarge Road Markings and is sold under the trademark THERMALINE™. Rubber, plastic or other materials suitable for inlaying in asphalt surface 10 could also optionally be employed. Template 20 may have a color and/or texture designed to contrast with asphalt surface 10. In one possible arrangement the depth of template 20 is less than or equal to the depth of impression 18 so that template 20 does not extend above the plane of asphalt surface 10 when it is inlaid in position. In another possible arrangement, the depth of template 20 exceeds that of impression 18 so that template 20 is raised above the plane of asphalt surface 10 when set in position. In this latter arrangement template 20 is both visually and tactilely distinguishable from asphalt surface 10. This may be useful, for example, in regulating the speed of vehicles traversing a paved roadway or the like.

In one embodiment of the invention templates 12 and 20 are formed from a plurality of frame elements 13 which are relatively narrow in width and are arranged in a grid (FIG. 3). This ensures that such templates can be readily compressed into asphalt surface 10 without the need to apply substantial compactive force. Also, in high traffic areas, frame elements 13 of relatively narrow width are less subject to wear. For example, frame elements 13 may have a width less than the width of a standard automobile tire. A width size between ¼ inch and 1 inch is suitable for most applications. Ordinarily frame elements 13 will not be less than ¼ inch in width to ensure that they are readily visible once template 20 is fixed in position (although they may be some applications where very narrow frame elements 13 could be employed).

The final step in the installation procedure is to fix second template 20 in position within impression 18. In the embodiment illustrated in FIG. 1(*f*), portable surface heater 14 is passed over the surface of second template 20 after it has been positioned within impression 18 to reheat surface 10. If template 20 is formed from a thermoplastic material as described above, this causes template 20 to flow into the interstices of impression 18 thereby enhancing adhesion to asphalt surface 10. Once template 20 is fully seated within impression 18, heater 14 is removed and template 20 is allowed to set in place. Alternatively template 20 may be pre-heated prior to its placement within impression 18 to facilitate template seating. Depending upon the material used, the second template 20 may be pre-heated or heated in situ to a temperature within the range of 100°–400° F., o r more particularly 150°–350° F.

Another possible means for fixing template 20 within impression 18 is by the use of conventional glue adhesives. For example, impression 18 could be coated with a glue adhesive prior to the placement of template 20 therein. The step of fixing template 20 in position could therefore include applying the glue and allowing the glue sufficient time to set. Alternatively template 20 may comprise a tear-off layer which may be removed on site to expose an adhesive surface capable of bonding to asphalt surface 10.

In one possible embodiment of the invention, template 20 may consist of reflective material suitable for designating pedestrian crosswalks, turning lanes and the like. In another embodiment template 20 may include a light source for illuminating template 20 in its inlaid position, such as for safety or decorative purposes. Similarly, template 20 may be formed from flourescent material or material which is luminescent when subjected to light of a suitable wavelength (such as ultraviolet light). In another embodiment template 20 may be constructed from a skid-resistant material.

In an alternative embodiment of the invention shown in FIG. 2 second template 20 may be compressed directly into asphalt surface 10 without first forming an impression 18 using first template 12. In order for this alternative method to work effectively asphalt surface 10 must be sufficiently pliable such that template 20 will not deform from the desired pattern when it is compressed into surface 10. As in the embodiment discussed above, surface 10 may be preheated to a pliable state (FIG. 2(*a*). As shown in FIGS. 2(*b*) and 2(*c*), template 20 is then compressed directly into surface 10. Surface 10 is then reheated after template 20 is in position to fix template 20 in place (FIG. 2(*d*)).

Figure 4A:
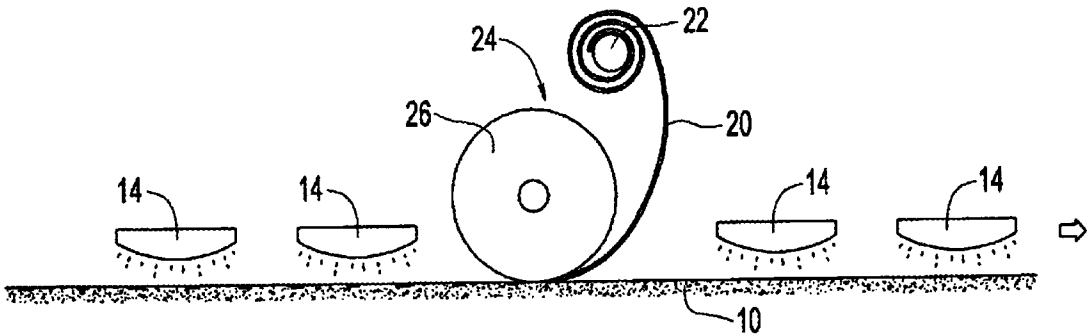
FIG. 4(*a*) is a diagrammatic side elevational view of the method of FIG. 2 wherein the template is delivered from a spool mounted on a vehicle having a drum roller.
Figure 4B:
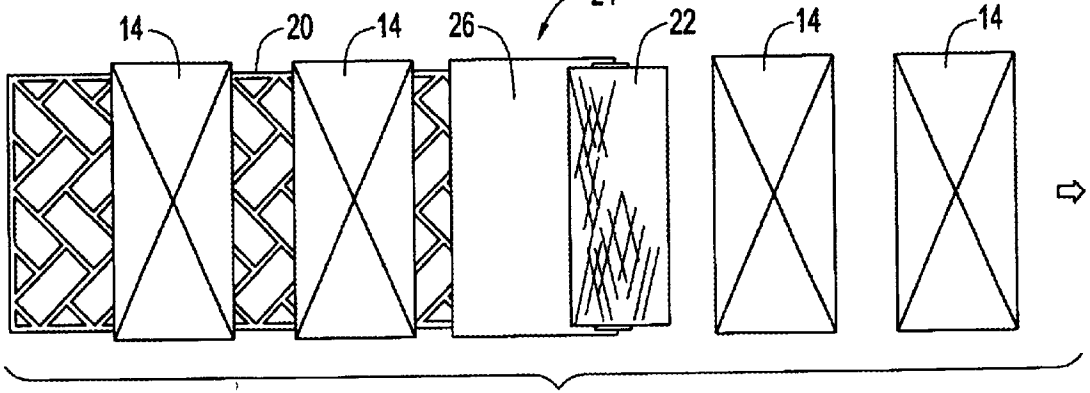

FIGS. 4(*a*) and 4(*b*) illustrate apparatus useful for carrying out the alternative method of the invention described above in an automated fashion. In the illustrated embodiment first template 20 is sufficiently flexible that it may be wound around a spool 22 mounted on a vehicle 24. Vehicle 24 also includes a drum roller 26 for progressively compressing template 20 into asphalt surface 10 as template 20 is unwound from spool 22. Portable surface heaters 14 move in advance of and behind vehicle 24 to pre-heat and re-heat the asphalt surface.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of forming an inlaid pattern in an asphalt surface comprising:

(a) providing a first template having a predetermined pattern;

(b) impressing said first template into said asphalt surface when said asphalt surface is in a pliable state to form an impression therein;

(c) removing said first template from said asphalt surface to expose said impression;

(d) providing a second template pre-formed as a grid at least partially matching the pattern of said first template;

(e) inserting said second template into said impression; and (f) fixing said second template in position within said impression to form said inlaid pattern.

2. The method as defined in claim 1, further comprising the step of heating said asphalt surface prior to impressing said first template into said asphalt surface.

3. The method as defined in claim 1, wherein the step of fixing said second template in position within said impression comprises heating said second template after insertion of said second template into said impression to cause said second template to bond to said asphalt surface.

4. The method as defined in claim 3, wherein said second template is heated to a temperature within the range of approximately 100°–400° F.

5. The method as defined in claim 3, wherein said second template is heated to a temperature within the range of approximately 150°–350° F.

6. The method as defined in claim 1, wherein said second template is formed into a thermoplastic grid prior to inserting said second template into said impression.

7. The method as defined in claim 6, wherein said second template is of unitary construction.

8. The method as defined in claim 1, wherein said second template has a color contrasting with the color of said asphalt.

9. The method as defined in claim 1, wherein said second template comprises a light source for illuminating said second template after said template is fixed in position within said impression.

10. The method as defined in claim 1, wherein said second template is luminescent.

11. The method as defined in claim 1, wherein said second template is flourescent.

12. The method as defined in claim 1, wherein said second template comprises an upper surface, wherein said upper surface is substantially flush with the surface of said asphalt when said second template is fixed in position.

13. The method as defined in claim 1, wherein said second template comprises an upper surface, wherein said upper surface is recessed below the surface of said asphalt when said second template is fixed in position.

14. The method as defined in claim 1, wherein said second template comprises an upper surface, wherein said upper surface projects above the surface of said asphalt when said second template is fixed in position.

15. The method as defined in claim 1, wherein second template comprises a grid pre-formed from a plurality of frame elements prior to inserting said second template into said impression, and wherein said pre-formed frame elements have a width less than 12 inches.

16. The method as defined in claim 15, wherein said frame elements have a width between ¼ inch and 2 inches.

17. The method as defined in claim 1, wherein said predetermined pattern is decorative.

18. The method as defined in claim 1, wherein said predetermined pattern is non-linear.

19. The method as defined in claim 4, wherein said heating comprises passing a portable surface heater over an upper surface of said second template after said second template has been inserted into said impression.

20. A method of forming an inlaid pattern in an asphalt surface comprising:

(a) providing a first template having a predetermined pattern;

(b) after the preceding step, impressing said first template into said asphalt surface when said asphalt surface is in a pliable state to form an impression therein;

(c) after the preceding step, removing said firt template from said asphalt surface to expose said impression;

(d) after the preceding step, providing a thermoplastic second template pre-formed as said grid at least partially matching the pattern of said first template, (e) after the preceding step, inserting said second template pre-formed as said grid into said impression; and (f) after the preceding step, fixing said second template in position within said impression to form said inlaid pattern by using a portable heater in proximity to said second template.

21. The method as defined in claim 20 wherein the second template comprises a unitary grid of frame elements.

22. The method as defined in claim 21 wherein each said frame element is between approximately 0.25 and 2.0 inches in width.

23. The method as defined in claim 20 further comprising the step of pre-heating the asphalt surface after forming the impression.

24. The method as defined in claim 20 further comprising the step of pre-heating the asphalt surface by using a portable heater prior to the impressing step.

25. A method of forming an inlaid pattern in an asphalt surface comprising:

(a) providing a first template having a predetermined pattern;

(b) after the preceding step, impressing said first template into said asphalt surface when said asphalt surface is in a pliable state to form an impression therein;

(c) after the preceding step, removing said first template from said asphalt surface to expose said impression;

(d) after the preceding step, providing a thermoplastic second template pre-formed as said grid at least partially matching the pattern of said first template, (e) after the preceding step, inserting said second template previously pre-formed as said grid into said impression; and (f) after the preceding step, fixing said second template in position within said impression to form said inlaid pattern by passing a portable heater over the surface of said second template.

* * * * *